US005628651A

United States Patent [19]

Yamanashi

[11] Patent Number: 5,628,651

[45] Date of Patent: May 13, 1997

[54] FIXING MECHANISM FOR CONNECTOR TO STRUCTURAL OBJECT

[75] Inventor: Makoto Yamanashi, Haibara-gun, Japan

[73] Assignee: Yazaki Corporation, Tokyo, Japan

[21] Appl. No.: 682,070

[22] Filed: Jul. 11, 1996

[30] Foreign Application Priority Data

Jul. 13, 1995 [JP] Japan ..... 7-177177

[51] Int. Cl.[6] ..... H01R 13/73

[52] U.S. Cl. ..... 439/557

[58] Field of Search ..... 439/557, 556, 439/489

[56] References Cited

FOREIGN PATENT DOCUMENTS 55-44317 10/1980 Japan .
4-33666 8/1992 Japan .

*Primary Examiner*—Neil Abrams
*Assistant Examiner*—Christopher Goins
*Attorney, Agent, or Firm*—Armstrong, Westerman, Hattori, McLeland & Naughton

[57] ABSTRACT

In an fixing mechanism of a connector for a structural object which causes a pair of connectors engaged each other to connect to a bulkhead board of a structural object such as a panel of a vehicle, causing the engagement securing member to mount on the female connector housing, when the connector housings are not in engagement with each other, since the engagement stopping projection of the engagement securing member stops displacement of the panel combining arm to the downward, combination of the structural object with the female connector housing is interrupted, when the connector housings are in engagement with each other, it causes said elastic locking arm to displace upward by the resilient locking piece of the male connector housing so that said engagement securing member is capable of being retreated, whereby the structural object is capable of combining with the panel combining arm under the displacement-inhibition for the panel combining arm released.

2 Claims, 9 Drawing Sheets

FIXING MECHANISM FOR CONNECTOR TO STRUCTURAL OBJECT

BACKGROUND OF THE INVENTION

1. Field of the Invention

The present invention relates to a fixing mechanism for a connector to a structural object in which it causes a pair of connectors engaged with each other to connect to a bulkhead board of the structural object such as a door-panel or an instrument panel of a vehicle with the bulkhead board penetrated.

2. Description of the Prior Art

Conventional connectors for connecting the electric wires on a bulkhead board portion of vehicles have been disclosed, for example in the Japanese Utility Model No. 55-44317, as a compound connector K as shown in FIG. 16.

The compound connector K comprises a case portion a and a detachable connector b engaging with the case portion a, the compound connector K is fixed to a bulkhead board d by a panel locking arm c provided for the case portion a. A grommet e covers the case portion a.

Such compound connector is of the connector being fixed to the bulkhead board d by the panel locking arm c, compared therewith a connector K' with a lock securing member f is proposed in the Japanese Utility Model Publication No. 4-33666 as shown in FIG. 17, in an attempt to ensure an engagement between the case portion a and the detachable connector b. In FIG. 17, it causes the lock securing member f employed for the connector K' to mount on the detachable connector b for ensuring an ascertainment of an engagement to the case portion a. The lock securing member f is of a member for preventing a breakaway about both of housings M and F after an engagement between a male housing M and a female housing F.

However, although the lock securing member f is adapted to the connector, since the case portion a is covered by the grommet e, an operator can not ascertain an operation of the lock securing member f, accordingly the case portion a is fixed to the bulkhead board d in such a manner as incomplete engagement, consequently there is a problem that a defect rises caused by an engagement error after assembly.

SUMMARY OF THE INVENTION

In view of the foregoing, it is an object of the present invention to provide a fixing mechanism for a connector to a structural object which is capable of stopping previously an engagement error for connector housings by avoiding an engagement to a structural object in the condition that an engagement between the connector housings is incomplete.

According to one aspect of the present invention, for achieving the above-mentioned object, there is provided a fixing mechanism for a connector to a structural object by which a pair of connectors are combined with an opening portion of the structural object through a panel combining arm in which the locking arm for locking connector housings each other is provided at one connector housing of a pair of connectors engaged with each other, and a locking part for said locking arm and a panel combining arm for the structural object are provided at the other connector housing of the pair of connectors, the fixing mechanism for the connector to the structural object comprises an engagement securing member having a resilient locking piece mounted on the one connector housing with a condition of moving freely toward the engaging position, a combining securing member having both an elastic locking arm with an activating projection activated by the resilient locking piece and an engagement locking projection for the panel combining arm mounted on the other connector housing with a condition of moving freely toward the engaging position, an engagement-release driving rod for the resilient locking piece, and a frontal locking projection and a rear locking projection for the elastic locking arm, wherein in the case that the connector housings do not engage with each other, causing the elastic locking arm of the engagement securing member to engage with the frontal locking projection, the engagement stopping projection inhibits the displacement of the panel combining arm so as to avoid the combination toward the structural object, in the case that the connector housings engage with each other, the engagement-release driving rod causes the resilient locking piece to displace so as to release a temporal lock of the resilient locking piece caused by the ingress of the resilient locking piece toward the other connector housing, and it causes the elastic locking arm to displace upwardly by contact between the resilient locking arm and the activating projection, the engagement securing member is capable of being retreated by releasing the engagement between the resilient locking piece and the activating projection, whereby the opening portion of the structural object is capable of combining with the panel combining arm under the displacement-inhibition for the panel combining arm released.

Furthermore, it is desirable that the elastic locking arm is of a cantilevered-bar shaped elastic locking arm extending toward opposite position from the engaging position of both the connector housings.

As stated above, in the fixing mechanism for the connector to the structural object according to the invention, since it causes the engagement securing member mounted on the other connector housing to drive caused by the lock securing member mounted on the one connector housing, in the condition that the engagement of the connector housings each other is secured by the lock securing member, the engagement securing member is capable of being retreated by releasing the temporal lock between the resilient locking piece and the activating projection, thereby the structural object is capable of combining with the panel combining arm.

When the engagement between both of the connector housings A and B is incomplete, since the resilient locking piece of the lock securing member can not drive the elastic rocking arm of the engagement securing member, the temporal lock of the elastic locking arm is not released, there is remained the condition that the engagement stopping projection of the engagement securing member stops the displacement of the panel combining arm to the downward so that the combination of the panel combining arm with the structural object is incapacitated.

Consequently, the ascertainment for the engagement between connecter housings becomes easy, accordingly the occurrence of defects caused by the incomplete engagement is capable of being prevented previously.

The above and further objects and novel feature of the invention will be more fully understood from the following detailed description when the same is read in connection with the accompanying drawings. It should be expressly understood, however, that the drawings are for purpose of illustration only and are not intended as a definition of the limits of the invention.

DETAILED DESCRIPTION OF THE PREFERRED EMBODIMENTS

A preferred embodiment of the invention will now be described in detail referring to the accompanying drawings.

Figure 1:
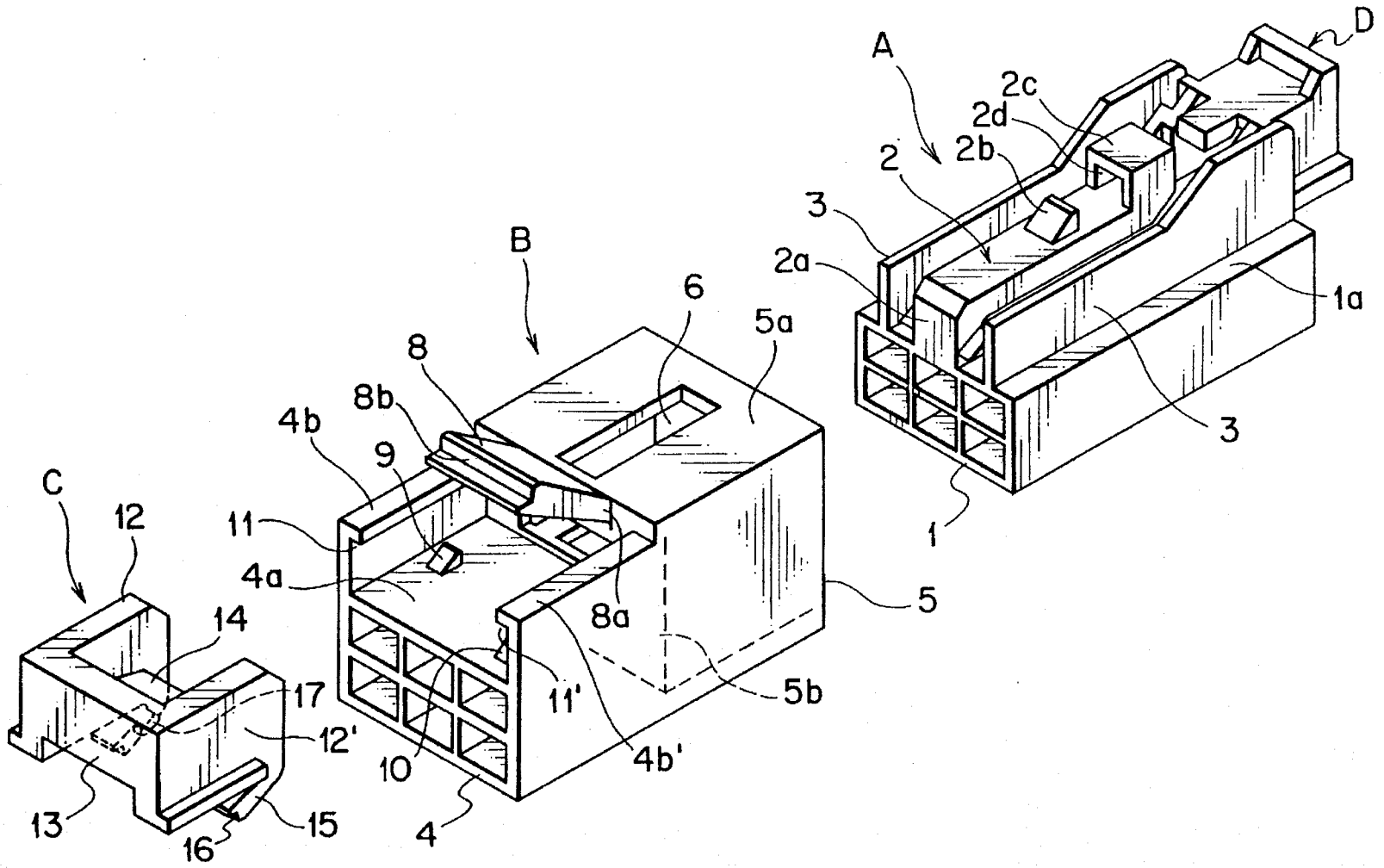
FIG. 1 is a cross sectional view showing a pair of connector-housings, an engagement securing member and a lock securing member according to one embodiment of the present invention.

FIG. 1 is the perspective view showing a connector according to an embodiment of the present invention with the connector separated. A is a male connector housing and B is a female connector housing. C is an engagement securing member which is mounted on the female connector housing B. D is a lock securing member which is mounted on the male connector housing A.

Both of the connector housings A and B which are engaged with each other are connected to a structural object such as a panel or a door for a vehicle through a panel combining arm 8 of the female connector housing.

A locking arm 2 extending backward through a rising base portion 2*a* provided at an upper wall 1*a* of a body portion 1 which receives terminals (not illustrated). A locking projection 2*b* is provided at an intermediate section of a locking arm 2, and an operating portion 2*c* is projected at a rear end portion. On both sides of the locking arm 2, protecting walls 3, 3 which stand in a direction parallel to the locking arm 2 with intervals. The lock securing member D is mounted between the protecting walls 3, 3 under the condition that the lock securing mender D moves freely toward the engaging position.

Figure 2:
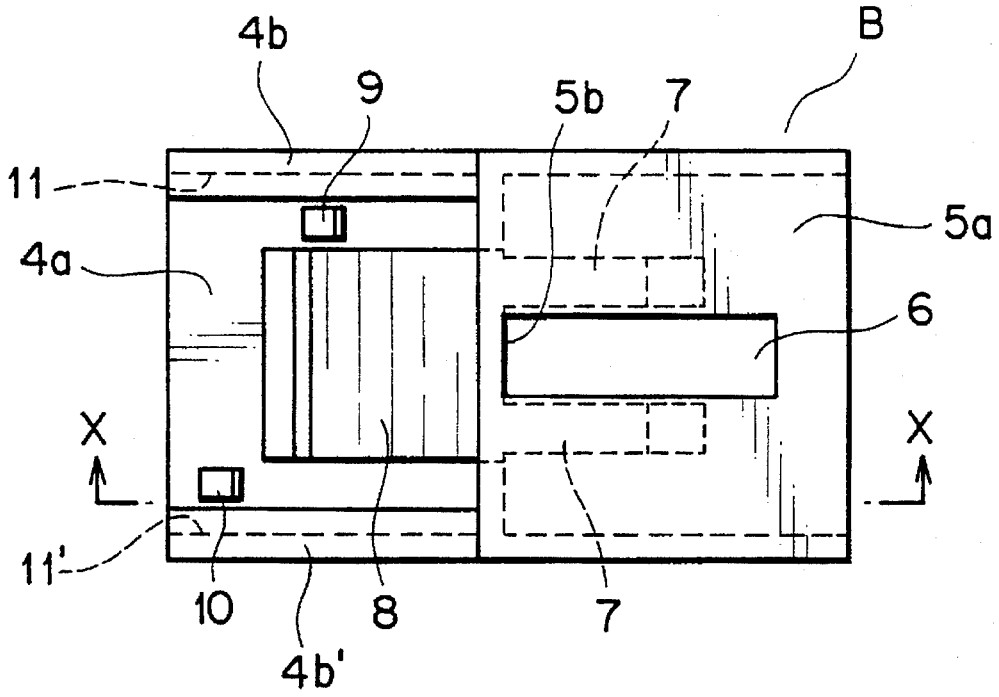
FIG. 2 is a plan view showing a female connector housing of FIG. 1.
Figure 3:
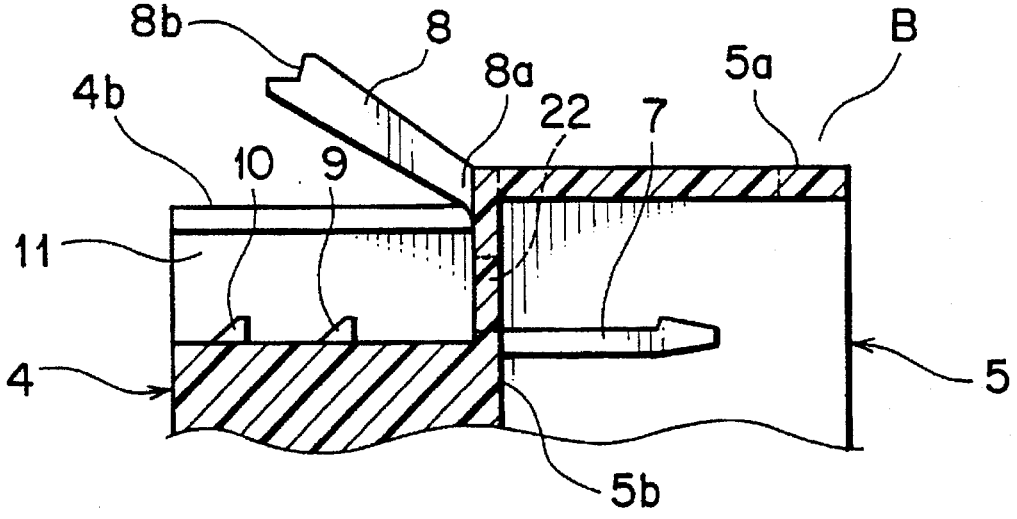
FIG. 3 is a cross sectional view showing a principal portion of the female connector housing of FIG. 2 along the line X—X.

A covering portion 5 which receives the male connector housing A is formed in front of the body portion 4 receiving the terminals (not illustrated) on the female connector housing B. A locking hole 6 is formed in the center of the upper wall 5*a* of the covering portion 5. As shown in FIGS. 2 and 3, on the inside of the covering portion 5, two pieces of engagement-release driving rods 7, 7 which extends ahead from a partitioning wall 5*b* are provided in the cantilever-shaped condition.

A panel combining arm 8 extending diagonally up to the rearward through the rising base portion 8*a* is provided at the upper portion of the partitioning wall 5*b*. A locking step portion 8*b* is formed at a free end portion of the panel combining arm 8*a*. A frontal locking projection 9 is provided at the right side front portion toward the engaging portion with the male connector housing A, and a rear locking projection 10 is provided at the left side rear portion toward the engaging position therewith on the upper wall 4*a* of the body portion 4. Guide walls 4*b*, 4*b*' for mounting the engagement securing member C are provided on both sides of upper wall 4*a*, and guide grooves 11, 11' are formed oppositely on the inside of the guide walls 4*b*, 4*b*'.

Figure 4:
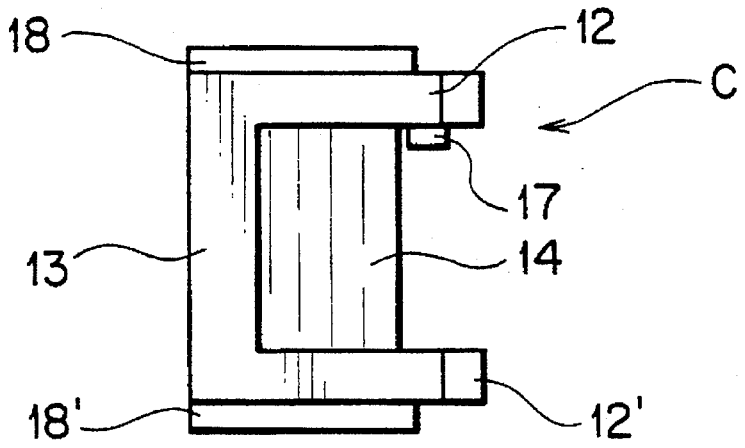
FIG. 4 is a plan view showing an engagement securing member of FIG. 1.
Figure 5:
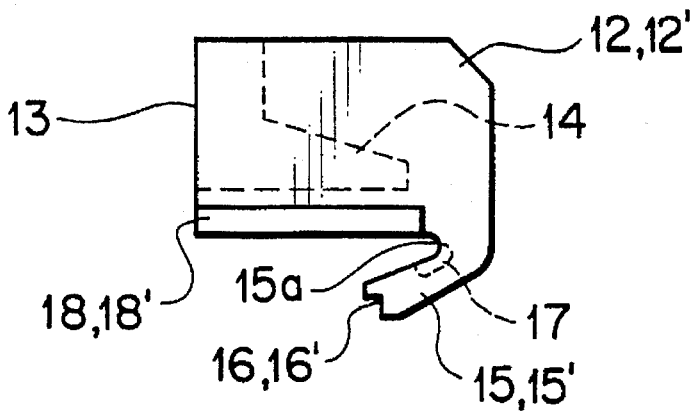
FIG. 5 is a side view showing the engagement securing member of FIG. 4.
Figure 6:
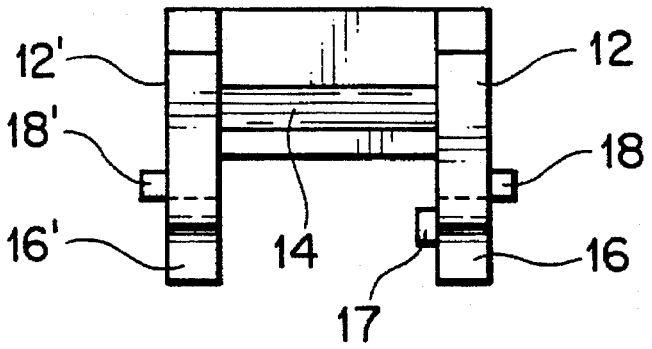
FIG. 6 is a front view showing the engagement securing member of FIG. 4.

As shown in FIGS. 4, 5 and 6, the engagement securing member C is formed by U-shaped sectionally surface in which opposite side walls 12, 12' are connected by a rear wall 13, and a combination-avoiding projection 14 projected ahead of the rear wall 13 is provided between the side walls 12, 12'. Elastic locking arms 15, 15' having rising base portions 15*a*, 15*a*' respectively in front thereof are provided diagonally down to the rearward at the lower portion of the side walls 12, 12'. locking hooks 16, 16' are formed at the free end portion of the elastic locking arms 15, 15' respectively. An activating projection 17 to the lock securing member D is provided at an intermediate section of one elastic locking arm 15.

Figure 7:
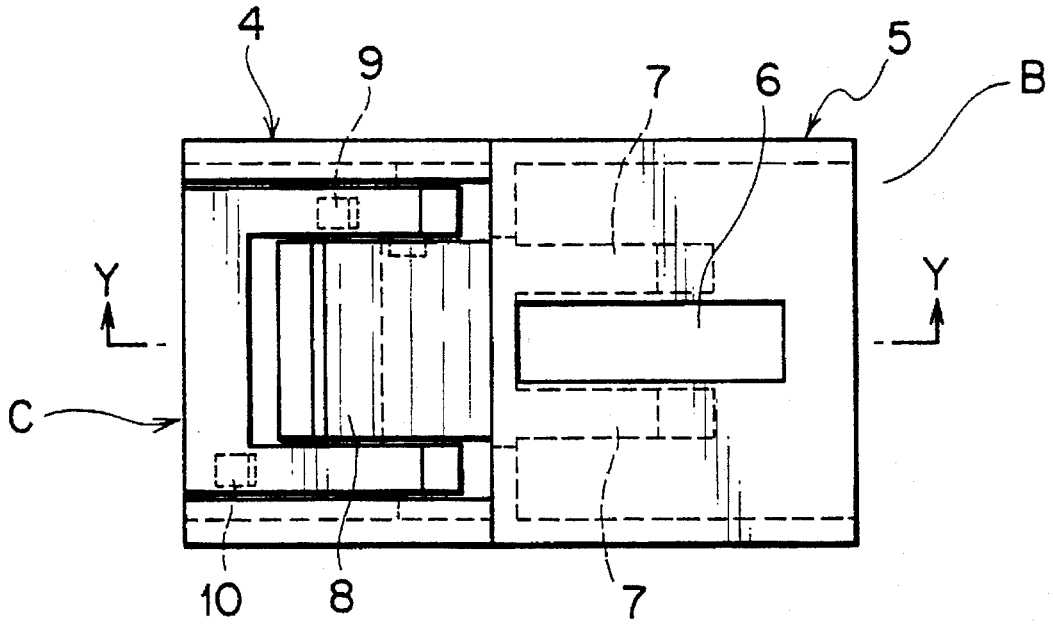
FIG. 7 is a plan view showing a mounted condition of the engagement securing member to the female connector housing of FIG. 1.
Figure 8:
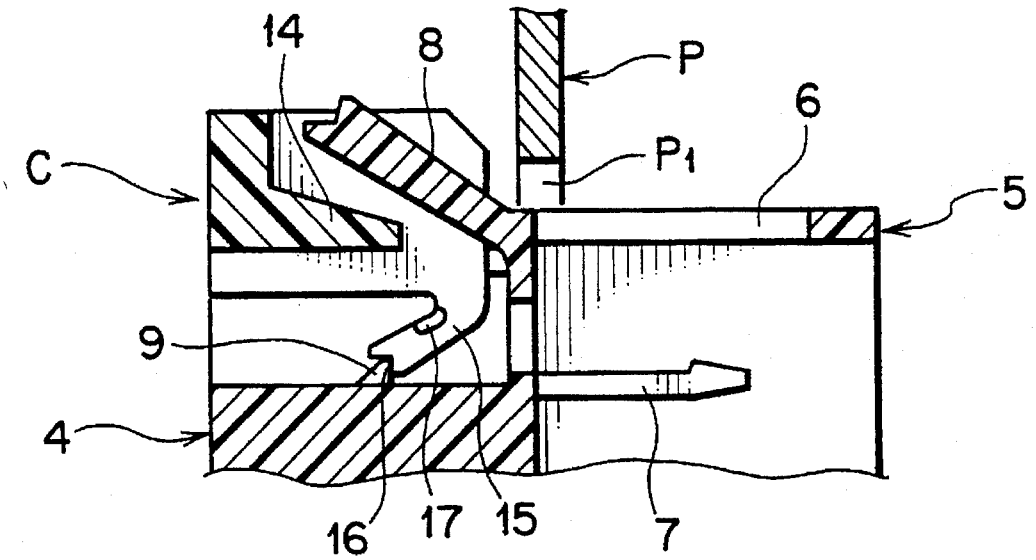
FIG. 8 is a cross sectional view along the line Y—Y of FIG. 7.

Introducing ribs 18, 18' are provided at the outer side of the side walls 12, 12' respectively. As shown in FIGS. 7 and 8, the engagement securing member C is mounted on the female connector housing A, and the locking hook 16 of one elastic locking arm 15 is engaged with the frontal locking projection 9 of the female connector housing B so as to lock therewith provisionally on account of inserting the introducing ribs 18, 18' into the guide grooves 11, 11' of the female connector housing B respectively.

In this condition, since the engagement stopping projection 14 of the engagement securing member C stops the displacement of the panel combining arm 8 downward, the panel combining arm 8 is incapable of being inserted into an opening portion P1 provided at the structural object P, accordingly combination of the structure with the female connector housing B is impossible. Furthermore, the locking hook 16' of the other elastic locking arm 15' engages with the rear locking projection 10 when the engagement securing member C retreated as describing later.

Figure 9:
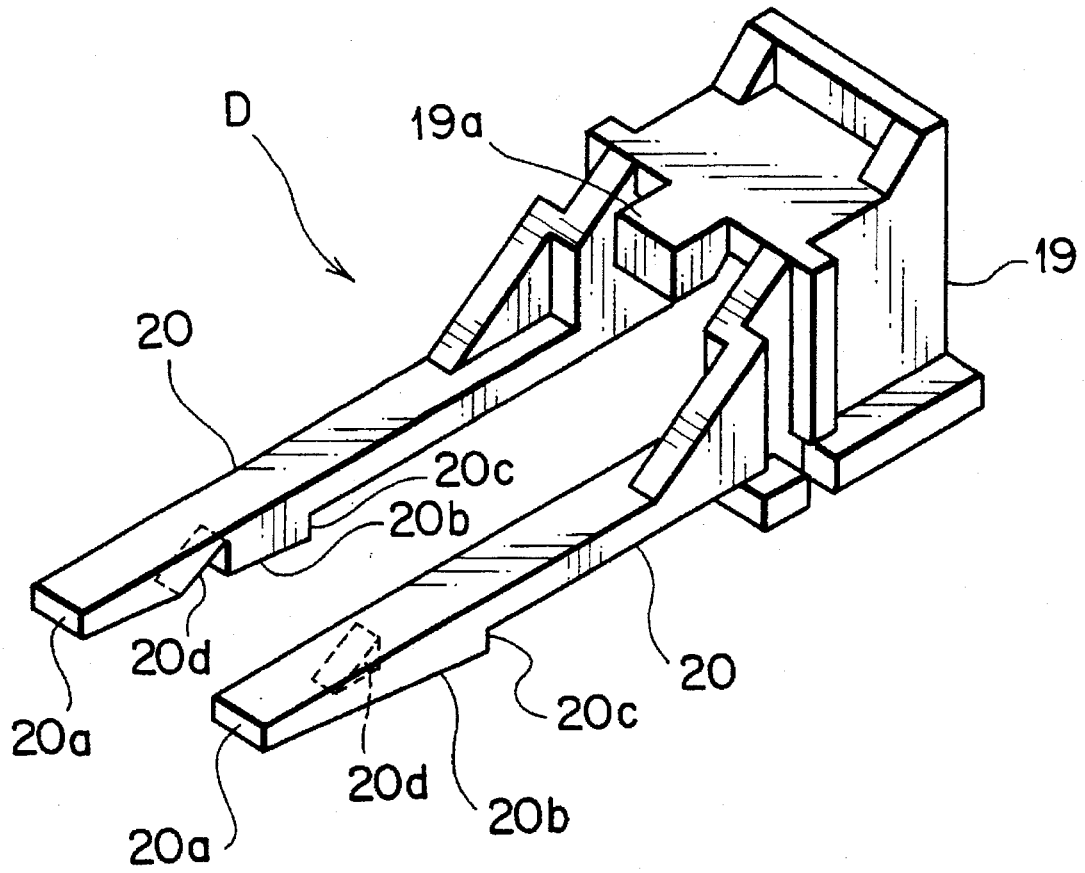
FIG. 9 is a perspective view showing the lock securing member of FIG. 1.

As shown in FIG. 9, the lock securing member D has a two-pronged-shape resilient locking pieces 20, 20 extending so as to position on both sides of the locking arm 2 from the gate-shaped base portion 19, and a hook-release stopping portion 19*a* which is inserted into a hole 2*d* penetrated at an operating portion 2*c* of the locking arm 2 on the base portion 19.

An activating tapered surface 20*b* and an escaping concave portion 20*c* continuing thereto are formed at a lower surface continuing to the free end 20*a* of the resilient locking piece 20. An engaging concave portion 20*d* is formed at the inside of the activating tapered surface 20*b*.

Figure 10:
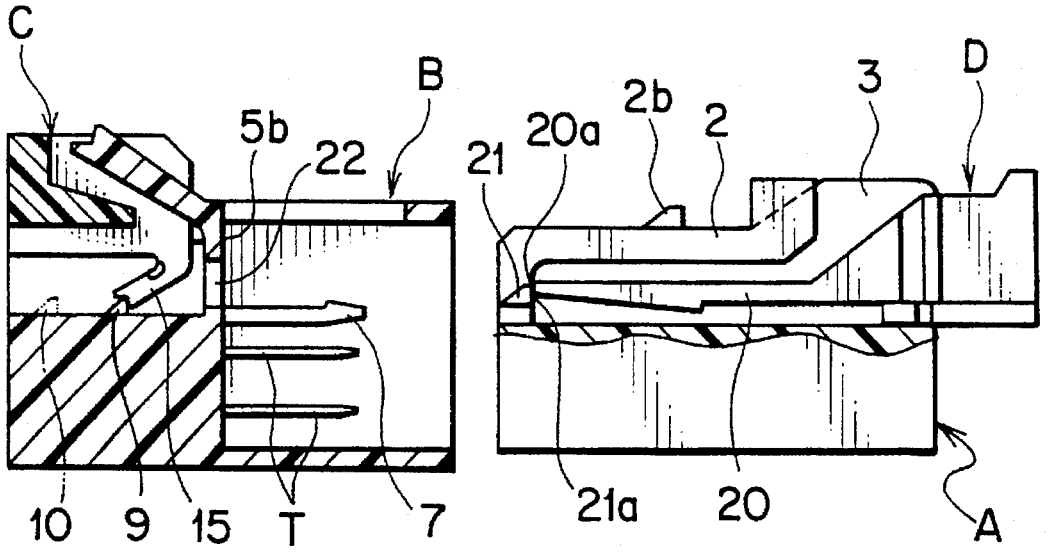
FIG. 10 is an explanation-view showing the operation of the lock securing member for engagement with the connector housings and the engagement securing member.

As shown in FIG. 10, the lock securing member D causes a contacting surface 21*a* of an engaging projection 21 provided at the male connector housing A to come into contact with the free end 20*a* of the resilient locking piece 20 so that the lock securing member D is held at the position of a temporal lock, in the case of causing the lock securing member D to push between protecting walls 3, 3 of the male connector housing A from the rearward. T is a male terminal received within the female connector housing B.

Figure 11:
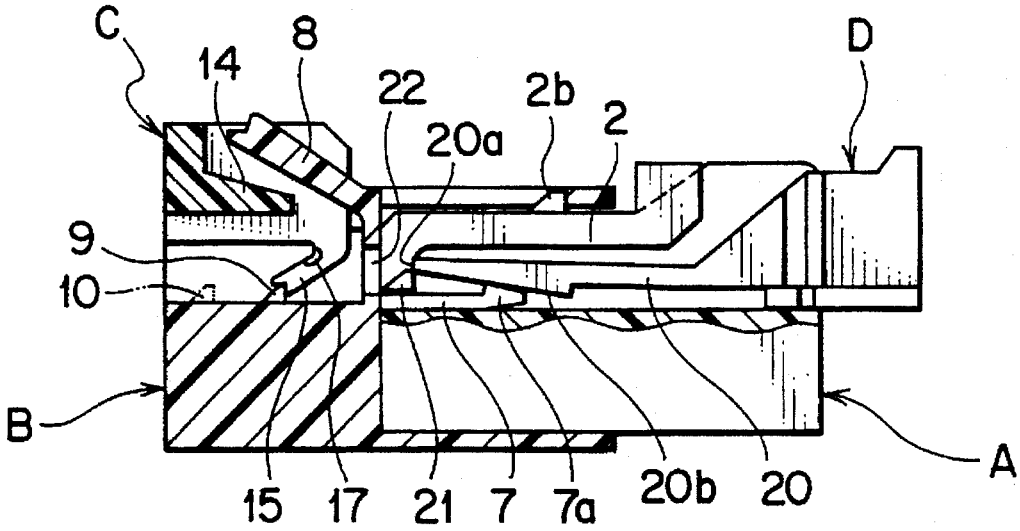
FIG. 11 is an explanation-view showing the engagement condition between connector housings of FIG. 10.

As shown in FIG. 11, in this condition, when the connector housing A engages with the connector housing B, the locking projection 2*b* of the locking arm 2 is inserted into the locking hole 6, as well as the engagement-release driving rod 7 provided within the female connector housing B enters to a lower surface of the resilient locking piece 20 from the lower side of the engaging projection 21, and a driving projection 7*a* of the engagement-release driving rod 7 enters to the lower surface of the resilient locking piece 20 from the lower side of the engaging projection 21 so that the driving projection 7*a* of the engagement-release driving rod 7 comes into contact with the activating tapered surface 20*b*, causing the free end 20*a* of the resilient locking piece 20 to rise, with the result that the free end 20*c* is released from the contacting surface 21*a* of the engaging projection 21.

Figure 12:
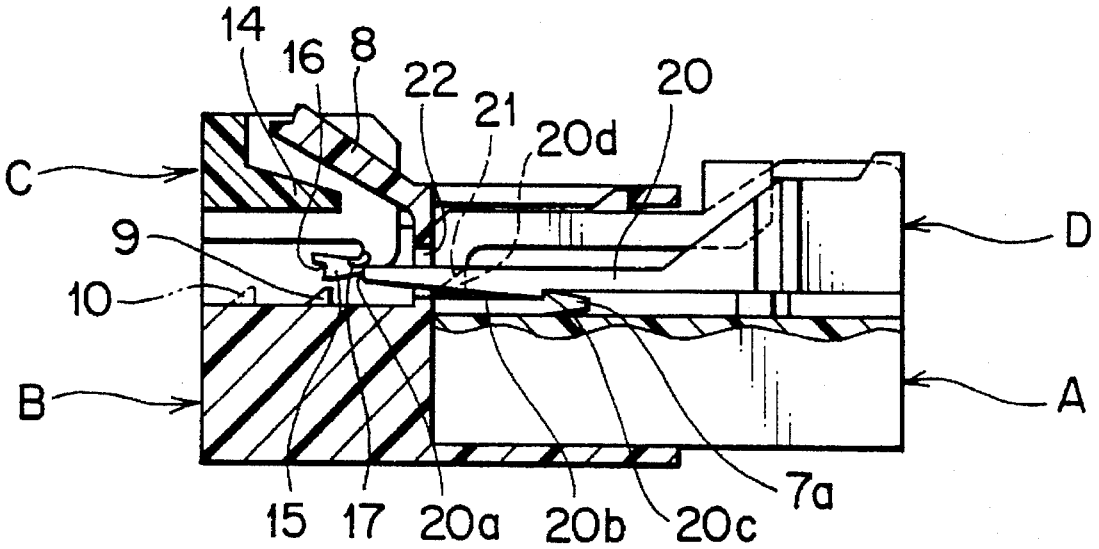
FIG. 12 is an explanation-view showing the condition that the lock securing member drives an elastic locking arm of the engagement securing member.

Next, in the case of causing the lock securing member D to push on, the resilient locking piece 20 is restored to the original state through the escaping concave portion 20*c* at the position where the driving projection 7*a* of the engagement-release driving rod 7 deviates from the activating tapered surface 20*b*, as shown in FIG. 12, the engaging concave portion 20*d* engages with the engaging projection 21 of the male connector housing A so as to reach the regular position for engagement.

At this time, the free end 20*a* of the resilient locking piece 20 projects from the operating hole 22 provided at the partitioning wall 5*b* so that the free end 20*a* comes into contact with the lower surface of the activating projection 17 provided at the elastic locking arm 15 of the engagement securing member C, causing the elastic locking arm 15 to displace upward so as to release the locking hook 16 from the frontal locking projection 9. As the result, the engagement-securing member C is capable of moving toward the rearward.

If the engagement between both of the connector housings A and B is incomplete and the free end 20*a* of the resilient locking piece 20 does not cause the elastic locking arm 10 to operate, there is remained that the locking hook 16 of the resilient locking arm 15 is locked with the frontal locking projection 9, and that the engagement stopping projection 14 stops the displacement of the panel combining arm 8 to the downward, the combination of the panel combining arm 8 with the structure P is incapacitated.

Figure 13:
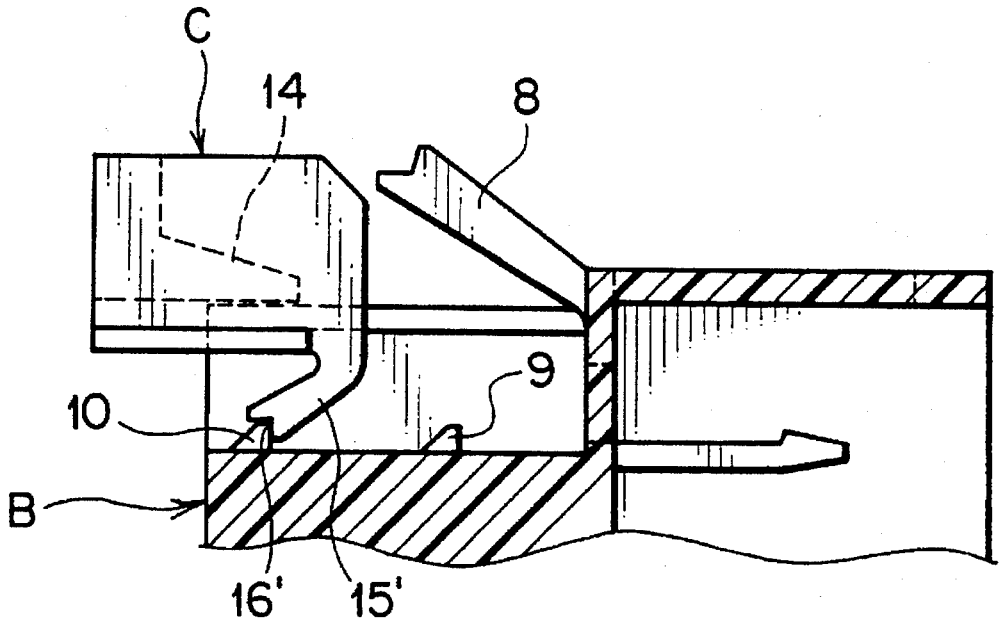
FIG. 13 is an explanation-view showing the engagement securing member driving it in reverse.
Figure 14:
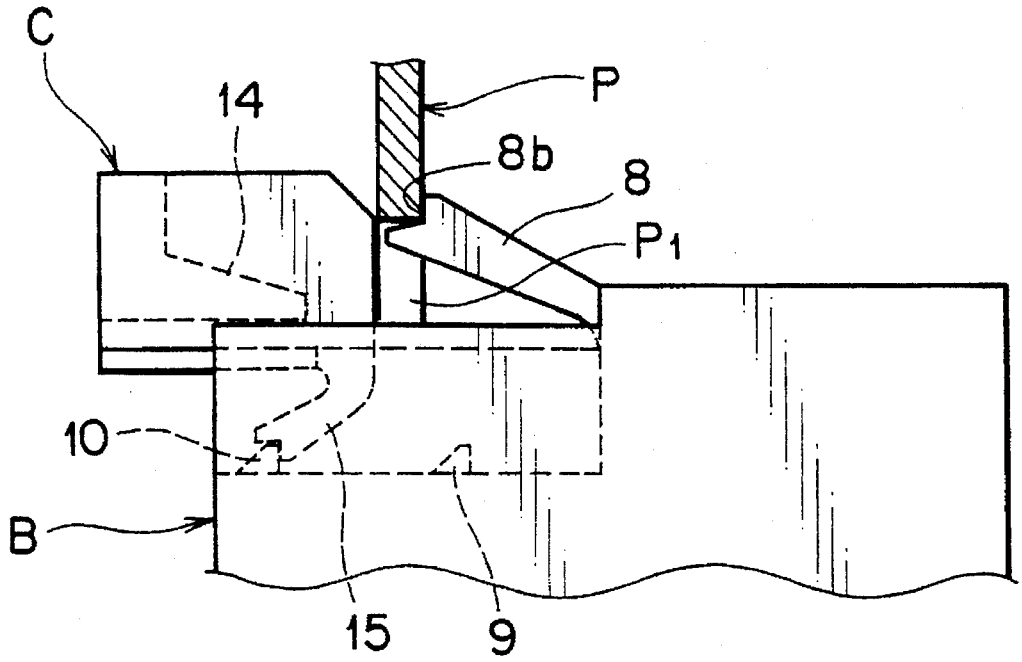
FIG. 14 is an explanation-view showing a condition that it causes the female connector housing to engage with a structure through the panel connecting arm.

When it causes the engagement securing member C to move rearward to the position where the locking hook 16 of the elastic locking arm 15 engages with the rear locking projection 10, as shown in FIG. 13, also the engagement stopping projection 14 retreats so that the displacement of the panel combining arm 8 to the downward becomes possible. Consequently, as shown in FIG. 14, it causes the female connector housing B to enter into the opening portion P1 (the position toward the male connector housing A) of the structural object P such as the panel and so forth, engaging the locking step portion 8*b* of the panel combining arm 8 with the edge portion of the opening portion P1, the female connector housing B is capable of being combined fixedly with the structural object P.

Figure 15:
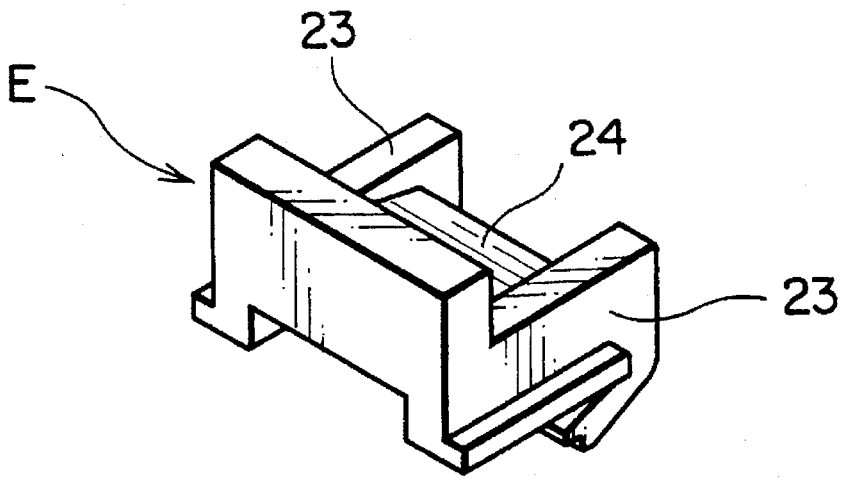
FIG. 15 is a perspective view showing an engagement detecting member mounted instead of the engagement securing member of FIG. 14.
Figure 16:
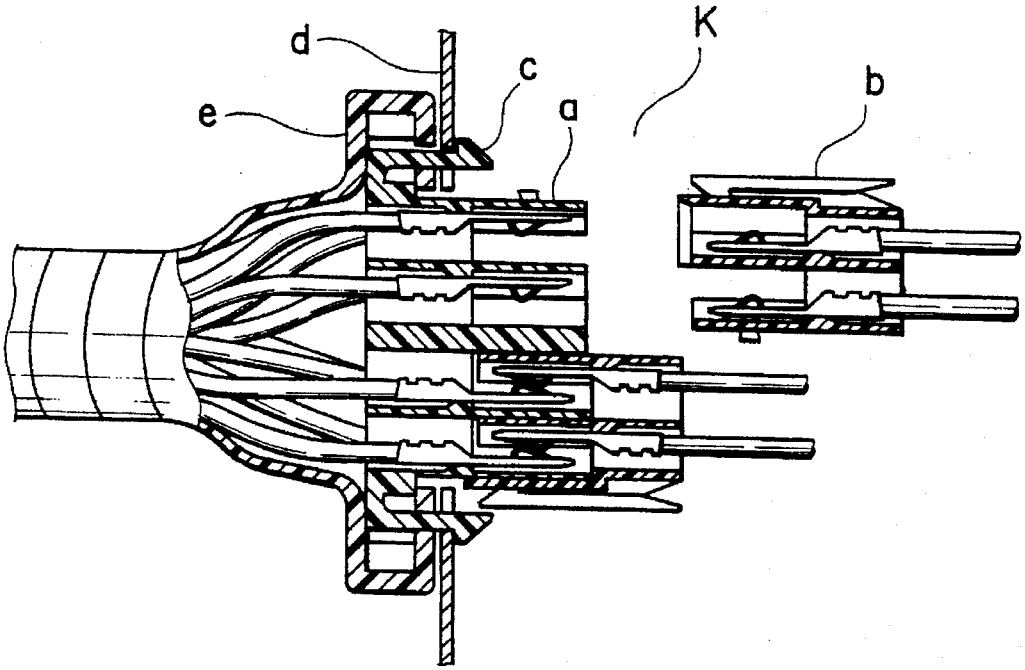
FIG. 16 PRIOR ART
FIG. 16 is a cross sectional view showing a compound connector provided with the conventional panel locking arm.
Figure 17:
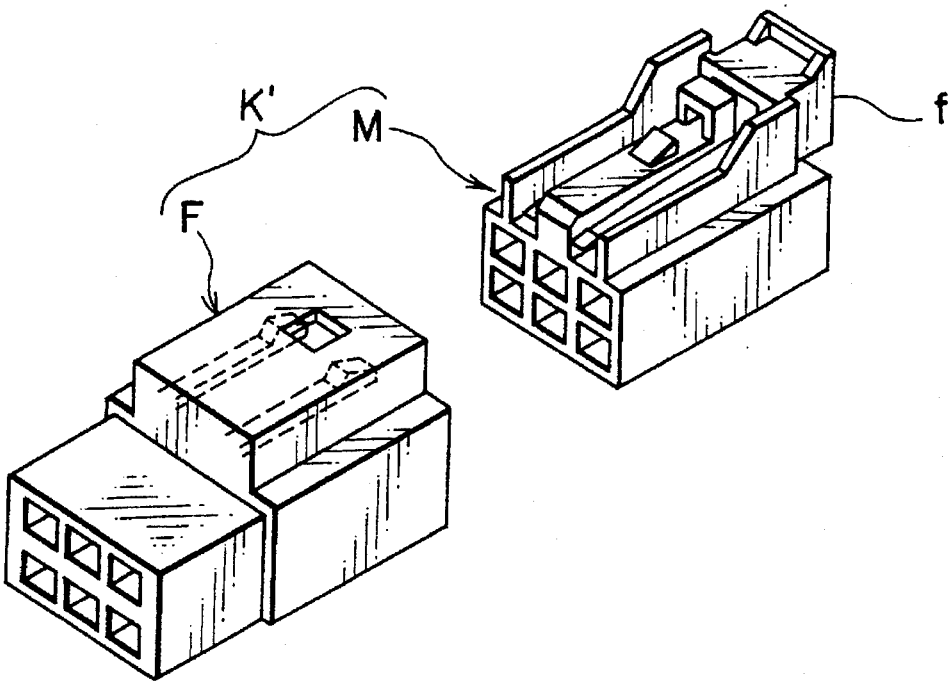
FIG. 17 PRIOR ART
FIG. 17 is a cross sectional view showing a compound connector with a conventional panel locking arm.

Furthermore, with mounting the combination-detection member E as shown in FIG. 15 on the female connector housing B instead of the engagement securing member C, it is capable of being detected incomplete combination of the panel combining arm 8 to the structural object P.

Opposite side walls 23, 23 of the combination-detection member E have a structure in which with cutting out the upper portion of the side walls 12, 12 of the engagement securing member C, the combination-detection member E is capable of entering into the inside of the opening portion P1 of the structural object P. The other structure is the same as the engagement securing member C.

The operation of the engagement detecting member is of the following steps that the connector housing A engages with the connecter housing B, the both connector housings A and B are combined with the opening portion P1 of the structural object P through the panel combining arm 8, and then it causes the engagement detecting member E to mount on the female connector housing B instead of the engagement securing member C. When it causes the engagement detecting member E to force into the direction of the male connector housing A, if the engagement detecting member E is capable of entering into the opening portion P1, it is ascertained that the panel combining arm 8 is combined completely with the opening portion P1 with the panel combining arm 8 displaced upward.

On the other hand, in case that the displacement of the panel combining arm 8 to the upward is insufficient, namely it is incomplete combination, since the engagement stopping projection 24 of the combination-detection member m comes into contact with the panel combining arm 8, entering of the combination-detection member E into the opening P1 becomes impossible, then incomplete combining thereof is capable of detecting immediately.

As described above, according to the present invention, since it causes the engagement securing member mounted on the other connector housing to drive caused by the lock securing member mounted on the one connector housing, in case that the engagement of mutual connector housings is incomplete, the combining of the panel combining arm with the structural object is impossible Consequently, the ascertainment for the engagement between mutual connecter housings becomes easy so that the occurrence of defects caused by the incomplete engagement is capable of being prevented previously. In particular, when the water-proof member such as the grommet is mounted on the connector housing, the incomplete engagement between the mutual connector housings is capable of being detected easily, with producing good results.

While preferred embodiments of the present invention have been described using specific terms, such description is for illustrative purpose only, and it is to be understood that changes and variations may be made without departing from the spirit or scope of the following claims.

What is claimed is:

1. In a fixing mechanism for a connector to a structural object by which a pair of connectors are combined with an opening portion of the structural object through a panel combining arm, in which a locking arm for locking connector housings together is provided at one connector housing of said pair of connectors, and a locking part for said locking arm and a panel combining arm for said structural object are provided at the other connector housing of said pair of connectors, said fixing mechanism for the connector to the structural object comprising:

an engagement securing member having a resilient locking piece mounted on the one connector housing in such a manner as moving freely toward engaging direction thereof;

a combination securing member having both an elastic locking arm with an activating projection activated by said resilient locking piece and an engagement locking projection for said panel combining arm mounted on the other connector housing in such a manner as moving freely toward the engaging position;

an engagement-release driving rod for said resilient locking piece; and a front locking projection and a rear locking projection for said elastic locking arm, wherein when said connector housings are not in engagement with each other, causing said elastic locking arm of said engagement securing member to engage with said front locking projection, said engagement stopping projection inhibits the displacement of said panel combining arm so as to avoid the combination toward said structural object, while when said connector housings are in engagement with each other, said engagement-release driving rod causes said resilient locking piece to displace so as to release a temporal lock of said resilient locking piece caused by the entering of said resilient locking piece toward the other connector housing, and it causes said elastic locking arm to displace upward by contact between said resilient locking arm and said activating projection activated thereby, said engagement securing member is capable of being retreated by releasing the engagement between said resilient locking piece and said activating projection, whereby said opening portion of said structural object is capable of combining with said panel combining arm with said displacement-inhibition of said panel combining arm released.

2. A fixing mechanism of a connector for a structural object according claim 1 wherein said elastic locking arm is of a cantilevered-bar shaped elastic locking arm extending toward opposite position from the engaging position of both said connector housings.

* * * * *